US011084305B2

(12) United States Patent
Thurailingam

(10) Patent No.: US 11,084,305 B2
(45) Date of Patent: Aug. 10, 2021

(54) METHOD FOR SECURING FLEXIBLE HINGES BINDING LAMINATE SHEETS INTO SECURITY DOCUMENTS AND SECURED SECURITY DOCUMENTS

(71) Applicant: Canadian Bank Note Company, Limited, Ottawa (CA)

(72) Inventor: Thivaharan Thurailingam, Stittsville (CA)

(73) Assignee: CANADIAN BANK NOTE COMPANY, LIMITED

( * ) Notice: Subject to any disclaimer, the term of this patent is extended or adjusted under 35 U.S.C. 154(b) by 0 days.

(21) Appl. No.: 16/817,283

(22) Filed: Mar. 12, 2020

(65) Prior Publication Data

US 2020/0207135 A1 Jul. 2, 2020

Related U.S. Application Data

(63) Continuation of application No. 15/576,004, filed as application No. PCT/CA2016/050573 on May 20, 2016, now abandoned.

(60) Provisional application No. 62/165,131, filed on May 21, 2015.

(51) Int. Cl.

| | |
|---|---|
| ***B42D 25/24*** | (2014.01) |
| ***B42D 25/373*** | (2014.01) |
| ***B42D 25/435*** | (2014.01) |
| ***B41M 3/14*** | (2006.01) |
| ***B41J 2/435*** | (2006.01) |
| ***D21H 21/40*** | (2006.01) |
| ***D21H 27/30*** | (2006.01) |
| ***B42D 13/00*** | (2006.01) |

(52) U.S. Cl.

CPC ..... *B41M 3/14* (2013.01); *B41J 2/435* (2013.01); *B42D 13/00* (2013.01); *B42D 25/24* (2014.10); *B42D 25/435* (2014.10); *D21H 21/40* (2013.01); *D21H 27/30* (2013.01)

(58) Field of Classification Search

CPC ..... B42D 25/24; B42D 25/373; B42D 25/435

See application file for complete search history.

(56) References Cited

U.S. PATENT DOCUMENTS

| | | | | |
|---|---|---|---|---|
| 6,089,614 A * | 7/2000 | Howland | B42D 25/373 | 283/109 |
| 7,710,551 B2 * | 5/2010 | Hersch | B42D 25/342 | 356/71 |
| 2014/0265301 A1 * | 9/2014 | Haas | B42D 25/373 | 283/85 |
| 2014/0319819 A1 * | 10/2014 | Power | B42D 25/373 | 283/85 |

(Continued)

*Primary Examiner* — Kyle R Grabowski

(74) *Attorney, Agent, or Firm* — Olson & Cepuritis, Ltd.

(57) ABSTRACT

A security document (e.g. passport) comprising a protective feature for authenticating a laminate data sheet thereof and method for making the same. A metalized flexible hinge attached to the laminate data sheet is used to bind the laminate data sheet into the passport with one or more other sheets at a binding of the passport such that at least a portion of the metalized surface of the flexible hinge is visible proximate to the laminate data sheet. Personalization data is etched on the visible portion of the metalized surface of the flexible hinge and matches personalization data of the laminate data sheet.

9 Claims, 3 Drawing Sheets

(56) References Cited

U.S. PATENT DOCUMENTS

| | | | | |
|---|---|---|---|---|
| 2016/0107472 | A1* | 4/2016 | Garcia Juez | B42D 25/351<br>283/94 |
| 2018/0304666 | A1* | 10/2018 | Brunet | B42D 25/328 |

* cited by examiner

METHOD FOR SECURING FLEXIBLE HINGES BINDING LAMINATE SHEETS INTO SECURITY DOCUMENTS AND SECURED SECURITY DOCUMENTS

CROSS-REFERENCE TO RELATED APPLICATIONS

This application is a continuation of U.S. patent application Ser. No. 15/576,004, filed Nov. 21, 2017, which in turn is a U.S. National Stage of PCT/CA2016/050573, filed May 20, 2016, and claims the benefit of U.S. Provisional Application No. 62/165,131, filed May 21, 2015, each of which is incorporated herein by reference in its entirety.

FIELD OF THE INVENTION

The invention relates to a security document and method for improving the security of a flexible hinge binding a laminate sheet into the security document such as a passport or other identification document to prevent unauthorized transfer of the laminate sheet to another such security document.

BACKGROUND

Security documents, such as passports, typically include both a personalized laminate data sheet and multiple flexible, thinner booklet sheets, typically made of paper, which are bound together to form the passport. The laminate sheet is comprised of a laminae of multiple layers of a hard, durable synthetic material, such as a laminate of polycarbonate, which may be personalized using a laser engraving process to provide greater security and/or may include an embedded chip and antenna used for personalization verification. The laminate sheet is provided with a flexible hinge extending from one side thereof that is used to bind it and the flexible (paper) sheets together, for example, by sewing together the flexible hinge and flexible sheets down the middle of the flexible sheet and then folding them at the sewing line whereby the fold edge becomes the bound side. The laminate sheet with flexible hinge used to bind the laminate sheet into the security document may be manufactured as described in the applicant's PCT publication number WO/2013/006939 published on 17 Jan. 2013.

However, persons seeking to alter security documents by modifying personal information presented on such laminate data sheets for illegal activities, are known to do so by cutting out the data sheet adjacent the sew line of the laminate sheet hinge and transferring it to another passport or replacing it with another laminate data sheet. The possibility of such a modification presents a serious security issue.

Therefore, it is desirable to provide a security feature to the flexible hinge attaching such a data sheet to the security document to make such modifications event and thereby prevent such modifications from occurring.

SUMMARY OF THE INVENTION

The present invention provides a security document comprising a laminate data sheet with an attached flexible hinge that is attached to a binding of the security document, the flexible hinge comprising personalization data for authenticating the laminate data sheet. A portion of the metalized flexible hinge attached to the laminate data sheet extends from a side of the laminate data sheet and binds with one or more other sheets at a binding of the security document, such that at least a portion of the metalized surface of the flexible hinge is visible proximate to the laminate data sheet. Personalization data etched on the visible portion of the metalized surface of the flexible hinge matches personalization data of the laminate data sheet.

The metalized flexible hinge may be a nylon film, for example, metalized with aluminum, and may comprise a complex pattern of metal deposits in rastor form or may comprise a solid metallic film. Further, the metalized flexible hinge may be metalized on both the upper and lower surfaces of the flexible hinge. When this is done there is an option to etch the surfaces in such a manner that at least a portion of the etched personalization data comprises offset etchings in the metalized surfaces, wherein different images are viewable upon viewing the flexible hinge from different angles relative to the surfaces. Preferably, the metalized surface of the flexible hinge is over coated with a protective coating which may comprise a UV curable ink.

Further, a method is provided for protecting the authenticity of a laminate data sheet of a security document. A laminate data sheet having an attached flexible hinge comprising a metalized surface is provided, wherein a portion of the metalized flexible hinge attached to the laminate data sheet extends from a side of the laminate data sheet. The flexible hinge attached to the laminate data sheet is bound together with one or more other sheets to form the security document, wherein at least a portion of the metalized surface of the flexible hinge is visible proximate to the laminate data sheet of the security document. Personalization data is laser etched onto the visible portion of the metalized surface of the flexible hinge wherein the etched personalization data matches personalization data of the laminate data sheet. Optionally, when the upper and lower surfaces of the flexible hinge are metalized the laser etching may be applied at an angle to surface of the flexible hinge to produce offset etchings in the metalized surfaces which are viewable at from different angles relative to the surfaces. The metalized surface may be formed by vapour deposition and an Nd:YAG laser may be used for the laser etching.

DESCRIPTION OF THE DRAWINGS

The present invention is described in detail below with reference to the following drawings in which like reference numerals refer throughout to like elements.

DETAILED DESCRIPTION

Figure 6:
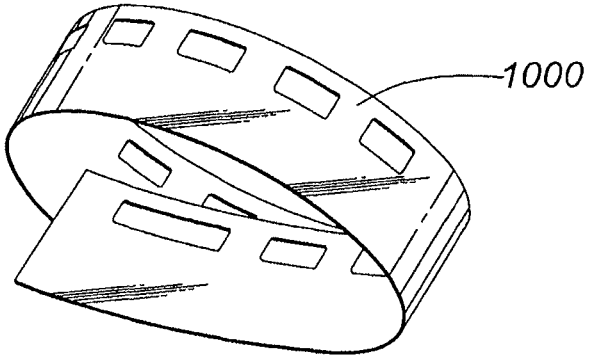
FIG. 6 depicts a metalized flexible hinge prior to using it to produce a laminate sheet with encased flexible hinge and binding such laminate sheet with hinge into a security document.

An improved method is provided for securing a flexible hinge in the area of a security document's binding 1200 that binds a laminate sheet 1100 to the security document such as a passport or other security document formed as a booklet. The laminate sheet 1100 comprises a plurality of hard synthetic material layers, selected to be polycarbonate sheets in the illustrated embodiment, which are laminated together. As described in the applicant's PCT publication number WO/2013/006939, before the polycarbonate sheets are laminated together a flexible hinge 1000, selected to be nylon, such as that shown in FIG. 6, is positioned between the polycarbonate layers so the side of the hinge comprising multiple apertures is positioned closest to the interior of the polycarbonate sheets and furthest to an outer hinge side of sheets. The polycarbonate sheets with the flexible hinge 1000 sandwiched between them are then laminated together. During lamination the lamination heat and pressure causes the synthetic material of the polycarbonate layers in the area of the apertures of the hinge 1000 to soften and move into the apertures to encase them. After the lamination the synthetic material hardens and the laminate sheet is securely attached to the flexible hinge 1000. Then the laminate sheet is flexed along a score line formed on the surface of the laminate sheet along an interior line of the outer hinge side of the laminate sheet to break away and remove the synthetic material layers extending from the score line, leaving the side of the flexible hinge opposite the apertures exposed and extending from the laminate sheet. As such, the part of the flexible hinge that extends from the laminate sheet is available for use to bind the laminate sheet to a passport booklet.

Figure 1:
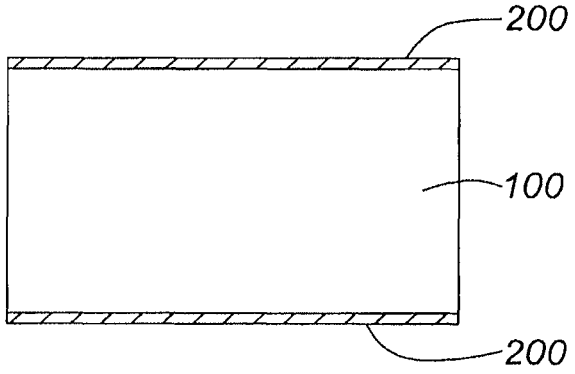
FIG. 1 is a cross-sectional view of a flexible nylon hinge, the upper and lower surfaces of which are covered by a metallic film (layer) produced by depositing metal onto those surfaces.
Figure 7:
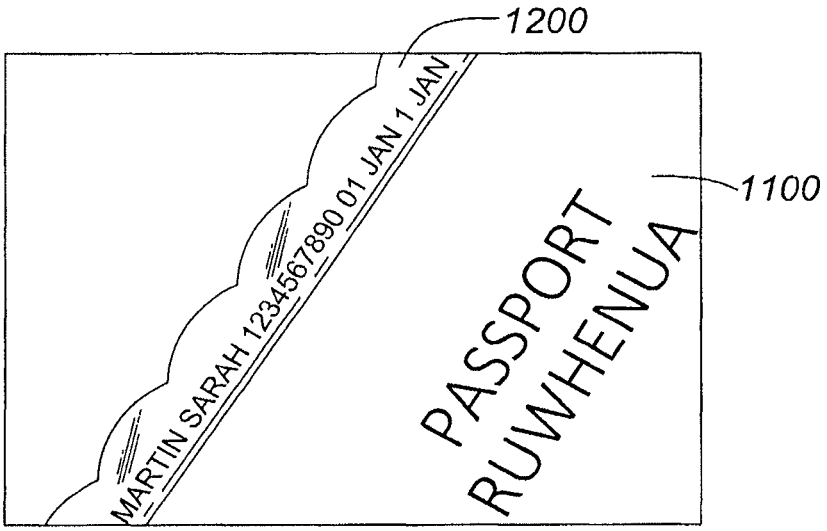
FIG. 7 depicts a security document having a laminate sheet bound therein by a metalized flexible hinge as shown in FIG. 6, the metallic surface of the flexible hinge comprising a complex pattern and personalized information etched therein in accordance with the invention.

Before the laminate sheet is laminated in this manner, however, the nylon film 100 of the flexible hinge 1000 is metalized to produce a metallic film 200 over its surface as shown by FIGS. 1 and 6. The metallization of the flexible hinge 1000 is illustrated by FIG. 1 showing a cross-sectional view of the nylon film 100 of the hinge wherein the upper and lower surfaces of the nylon hinge are covered by a metallic film 200. While it is not necessary to metalize both the upper and lower surfaces this is done for the illustrated embodiment so that the laser etching may be angled (see FIG. 2A) to produce an image that can only be seen under an oblique view. After the laminate sheet has been laminated, and the encased flexible hinge extending from and attached to the laminate sheet has been bound into the passport, at least a portion of the metalized surface of the flexible hinge is visible proximate to the laminate data sheet of the security document. Then, the metalized hinge is personalized by laser engraving/etching the metalized surface of the hinge in the area of the passport binding 1200 to securely link personalization data engraved on the laminate sheet to the passport. For example, the laminate sheet may be engraved with the name and/or other personal data for the person to whom it is to issue and some or all of the same personal data may be engraved/etched onto the metalized surface of the flexible hinge at the binding, as shown by FIG. 7 (the terms "engrave" and "etch" are used interchangeably here and hereinafter the term "etch" with reference to the personalization is intended to refer to either or both engraving and etching). Then, if any unauthorized removal of the laminate sheet and reattachment of a different laminate sheet to the binding were to occur, such tampering would be apparent upon inspection of the passport.

For the illustrated embodiments nylon is selected for the flexible hinge. The nylon film 100 is transparent and highly flexible. As an example for the production of the hinge, approximately 601 $m^2$ of 102 um thick nylon 6, 6 (C917 DARTEK®) corona treated film is utilized to produce approximately 250,000 hinges. The corona treatment increases the receptivity of the film to metallization. The treated nylon film is metalized on both sides of the film with approximately 280 Å thick aluminum deposited on both sides of the film. The metalized film is then slit into 90 mm width film on a 6" core. Then the film is perforated and slit into 19 mm width hinges as illustrated in FIG. 6.

Figure 3:
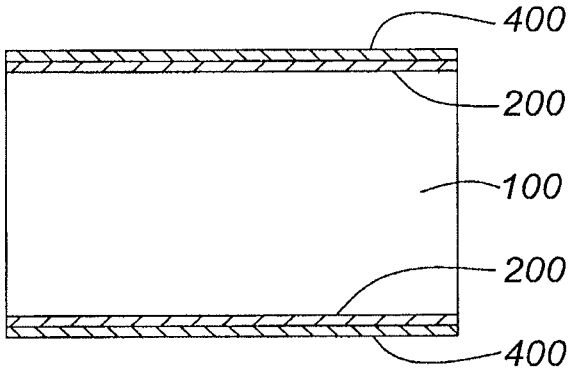
FIG. 3 is a cross-sectional view of the flexible hinge of FIG. 1 having metalized surfaces, wherein the metallic surfaces are over coated with a protective layer.

It is preferred to cover the metallic film layer 200 of the flexible hinge by a protective coating 400, as illustrated by FIG. 3, to protect the metalized nylon hinge against adhering to the polycarbonate sheets during lamination and causing some of the metallization to become removed. The protective coating 400 is printed or applied to the metallic film to prevent the aluminum from contacting the polycarbonate. UV curable inks/coatings are preferred for the protective coating to prevent bonding with polycarbonate.

Figure 4:
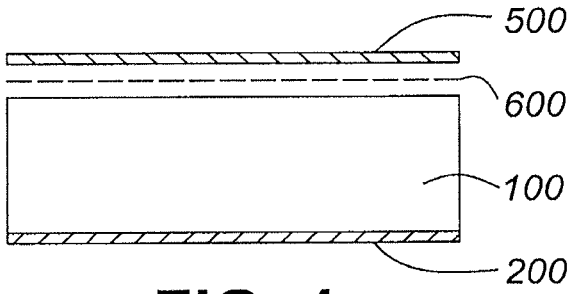
FIG. 4 is a cross-sectional view of a flexible hinge, such as a nylon film, the lower surface of which is covered by a metallic film or layer and the upper surface of which is coated by an adhesive layer with a film of thermoplastic polymer resin i.e. polyethylene terephthalate (PET).

In a further embodiment, illustrated by FIG. 4, a polyethylene terephthalate (PET) layer 500 is applied to the upper surface of the nylon 200 by an adhesive layer 600 and a metallic film 200 is applied to the lower surface of the nylon 200. Nano-embossments can be formed on the PET layer 500 to produce a hologram on the flexible film to further secure the passport.

The nylon film 100 is metallized using a known vapor deposition technique to deposit a thin metallic film, being aluminum for the illustrated embodiment, onto the upper and lower surfaces of the nylon film 100. Vapour deposition of metallic deposits (coatings) is used in the packaging industry and a number of services are available to do this, for example, Celplast Metallized Products Limited of Toronto, Ontario. Other types of radiation sensitive metals including gold, silver, vanadium, copper, zinc, tin, chromium, titanium, and alloys of these metals could be used instead of aluminum. Care must be taken during the vapor deposition to avoid scratching the metal. If both surfaces of the nylon file are to be metalized, it is preferred that both surfaces be metallized at once to minimize opportunity for the introduction of scratches. As an alternative to using a vapour deposition process to metalize the nylon surface, it may be possible to print onto the surface a coating of a metallic ink (known as mirror inks, using mainly for flexo and screen printing applications) which carries fine particles of metal such as aluminum. After printing, metallic inks dry and form a mirror-like feature similar to that achieve by the employed vapour deposition process. However, this may be undesirable for reasons of cost.

Figure 5A:
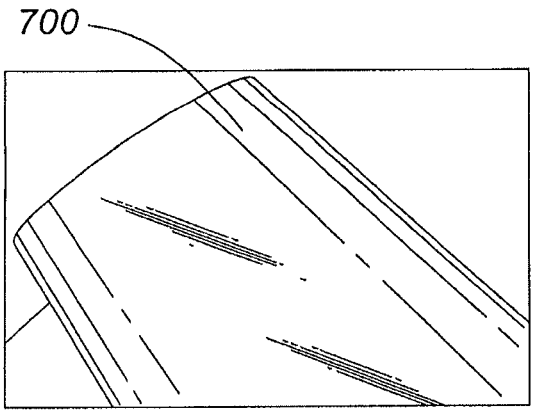
In FIG. 5, parts A and B depict alternative-type metallic layers over coating a flexible hinge, part A illustrating a solid metal coating of which metal is applied over the complete surface (i.e. 100% of the surface is coated with metal) and part B illustrating a rasterized metal coating of which the metal is applied on a pixelized basis to the surface (i.e. only predetermined pixels of the pixelized area are coated with metal) and the pixels are selected so as to form the image shown.
Figure 5B:
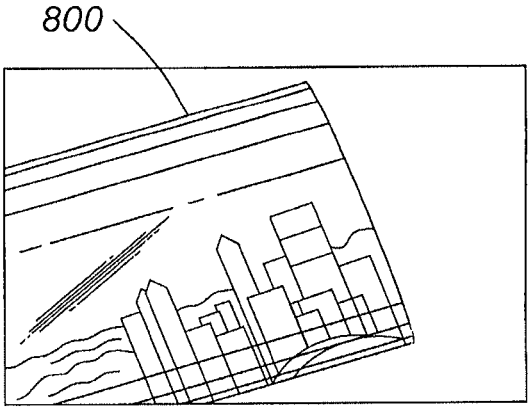

The metal deposits can be applied in solid form 700 with 100% coverage of the surface of nylon film 100 as illustrated by part A of FIG. 5. Alternatively, the metal deposits can be applied in raster form 800 (i.e. on a pixel basis) as illustrated by part B of FIG. 5. Advantageously, by applying the metallic deposits on a pixelated basis (i.e rasterizing the deposits), the metallization process can form a complex pattern or image on the hinge such as that shown by part B of FIG. 5.

Figure 2A:
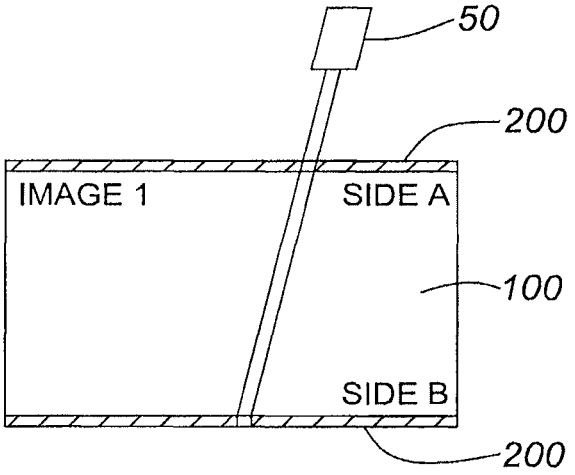
FIGS. 2A and 2B illustrate a step of laser etching the metallic surfaces of a flexible hinge such as that of FIG. 1, FIG. 2A being a cross-sectional view of the flexible hinge showing a laser beam applied at an angle to the upper surface, and FIG. 2B being a cross-sectional view of the same flexible hinge but showing (in exaggerated form, form illustrative purposes) etchings (openings) formed by energy of a laser beam at targeted (predetermined) locations in the upper and lower surfaces.
Figure 2B:
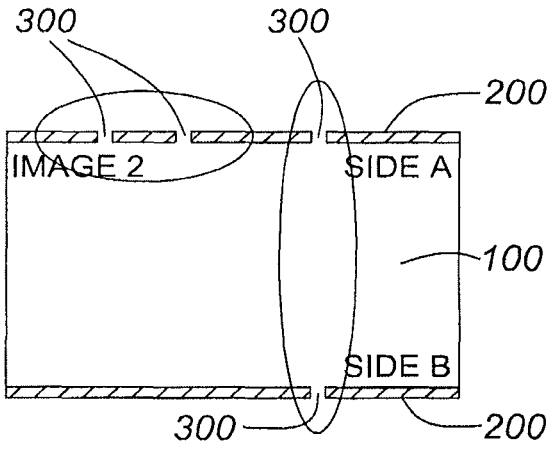

After the laminate sheet has been bound into the passport a visible portion of the metalized hinge in the area of the binding 1200 is personalized by laser engraving/etching to further increase the security of the laminate sheet. For example, this may be done using an Nd:YAG (neodymium-doped yttrium aluminum garnet) personalization laser or other types of lasers including but not limited to $YVO_4$, $CO_2$, etc., as will be understood by a person skilled in the field of security printing. Laser etching of the metalized hinge is illustrated by FIGS. 2A and 2B wherein sides A and B of the nylon 100 are laser etched to create etched areas or pixels 300 in the metallic surface layer of the film. By controlling the energy of the laser beam 50, it is possible to etch only side A or side A and B at the same time. Various types of etching can be done to increase the difficulty in counterfeiting or tampering, including but not limited to the following: (1) etch one side of the film using a low energy laser beam 50; (2) etch both sides of the film using a high energy laser beam 50; or, (3) etch at an angle using a high energy laser beam 50 so an image is created that can only be seen in transmitted light in an oblique angle. If personalization of the hinge is not desired, a static pattern (i.e. an image or information not specific to the person to whom the passport is to be issued) could be laser ablated on the metalized surface of the hinge after the metallization of the nylon and before it is laminated into the laminate sheet.

Laser engraving/etching procedures and materials are well known to persons skilled in the field of security printing and skilled persons will be readily able to perform laser engraving or etching according to the foregoing to produce a personalized marking or set of markings on the hinge in the area of the binding of the security document. Persons skilled in the field will also be readily able to apply the present invention to implement various applications of the same. Consequently, it is to be understood that the particular embodiment described herein by way of illustration is not intended to limit the scope of the invention claimed herein by the inventors and defined by the appended claims.

What is claimed is:

1. A method for protecting the authenticity of a laminate data sheet in a bound security document, the method comprising the steps:

providing a laminate data sheet bearing personalization data and having an embedded flexible hinge comprising a metalized surface, wherein a portion of the metalized flexible hinge embedded within the laminate data sheet extends from a side of the laminate data sheet; and wherein both an upper and a lower surface of the flexible hinge are metalized, binding together the flexible hinge embedded within the laminate data sheet and one or more other sheets to form the bound security document so that at least a portion of the metalized surface of the flexible hinge is visible proximate to the laminate data sheet of the security document; and thereafter, laser etching personalization data onto the visible portion of the metalized surface of the flexible hinge wherein the laser etching is applied at an angle to the surface of the flexible hinge to produce offset etchings in the metalized surfaces which are viewable from different angles relative to the surfaces and the etched personalization data matches personalization data of the laminate data sheet.

2. The method according to claim 1 wherein the metalized surface of the flexible hinge comprises metal deposits forming a complex image on the flexible hinge.

3. The method according to claim 1 wherein the metalized surfaces of the flexible hinge comprise metal deposits in solid form.

4. The method according to claim 1 wherein the metalized surfaces are formed by vapour deposition.

5. The method according to claim 1 wherein the metal is aluminum.

6. The method according to claim 1 wherein the flexible hinge is comprised of nylon.

7. The method according to claim 1 further comprising coating the metalized surfaces of the flexible hinge with a protective coating.

8. The method according to claim 7 wherein the protective coating is a UV curable ink.

9. The method according to claim 1 wherein an Nd:YAG laser is used for the laser etching.

* * * * *